United States Patent [19]

Patterson

[11] Patent Number: 4,892,310

[45] Date of Patent: Jan. 9, 1990

[54] RANDOM NUMBER SELECTION APPARATUS

[76] Inventor: Leonard H. Patterson, 740 Birmingham St., Bridgeport, Conn. 06606

[21] Appl. No.: 279,511

[22] Filed: Dec. 5, 1988

[51] Int. Cl.[4] ..... A63F 5/00

[52] U.S. Cl. ..... 273/144 A; 273/DIG. 30

[58] Field of Search ..... 273/144 R, 144 A, 144 B

[56] References Cited

U.S. PATENT DOCUMENTS

| | | | |
|---|---|---|---|
| 2,385,980 | 10/1945 | Fostos | 273/144 A X |
| 3,044,780 | 7/1962 | Silverman | 273/144 A |
| 3,679,212 | 7/1972 | Smith | 273/144 B |
| 4,280,702 | 7/1981 | Tremblay | 273/144 B |
| 4,583,736 | 4/1986 | Lorraine | 273/144 A X |

*Primary Examiner*—Anton O. Oechsle

*Attorney, Agent, or Firm*—Leon Gilden

[57] ABSTRACT

A random number selection apparatus is set forth wherein a sealed enclosure contains positionally therein a series of hollow spherical balls that are pneumatically projected throughout the enclosure by means of a blower fan wherein the spherical balls randomly land upon a downwardly directed chute diagonally oriented relative to the enclosure wherein a medial portion of the chute is of an ellipsoidal trough-like configuration with a medial elongate trough to accept the balls therein. The balls are drawn through a square cross-sectional conduit which further comprises an air intake for the lower fan and thereby randomly accepts a series of balls supporting a series of numbers thereon. The numbers are formed with magnetic members of a first polarity and are attracted to a series of overlying magnets of a reverse polarity to randomly orient the balls and provide for random number selection of the numbers positioned underlying the magnets.

8 Claims, 3 Drawing Sheets

FIG 1
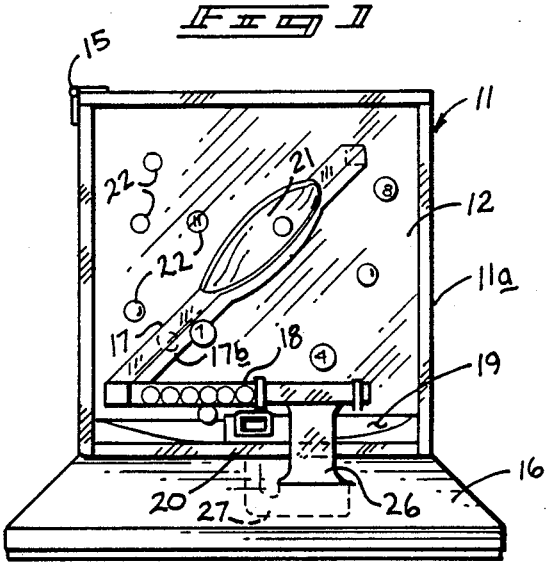
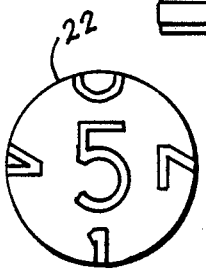
FIG 2
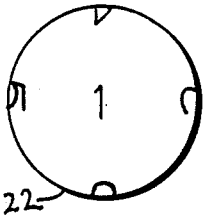
FIG 3
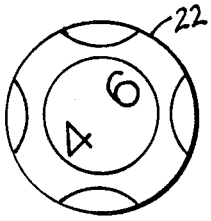
FIG 4
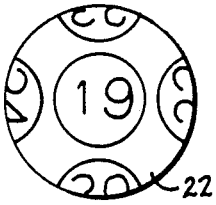
FIG 5
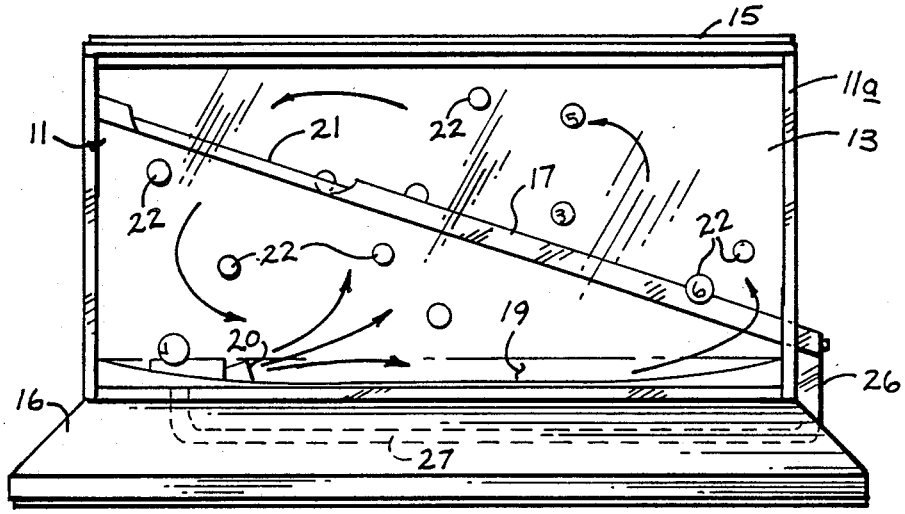
FIG 6

Fig 11
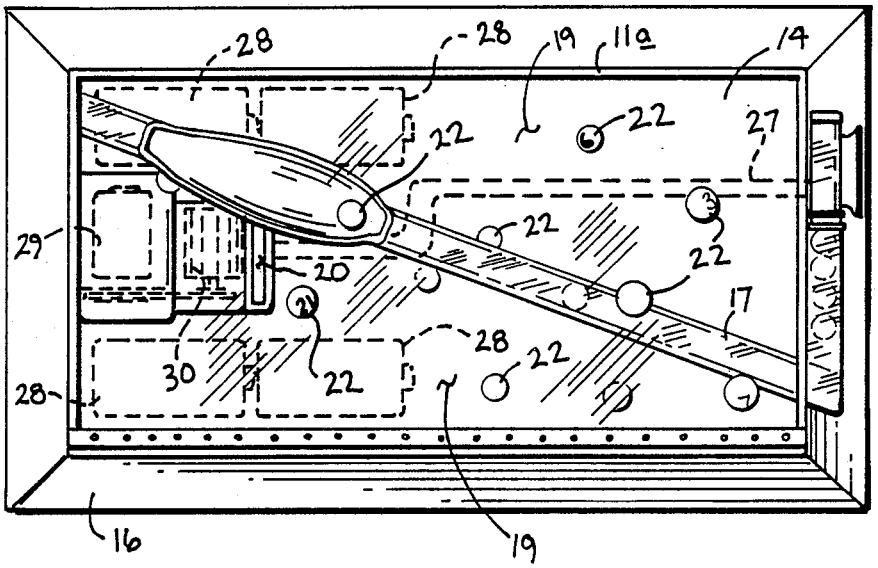
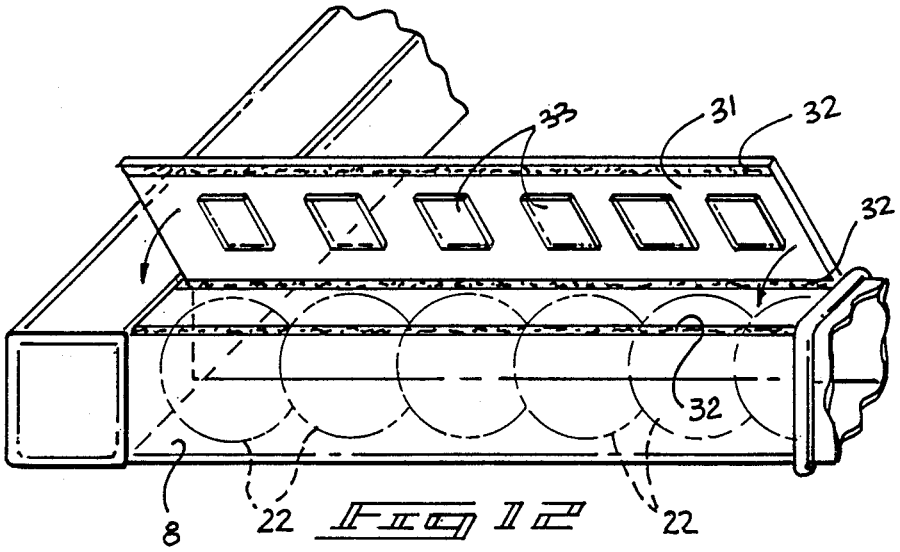
Fig 12

RANDOM NUMBER SELECTION APPARATUS

BACKGROUND OF THE INVENTION

1. Field of the Invention

The field of invention relates to random number selection apparatus, and more particularly pertains to a new and improved random number selection apparatus wherein the same provides for pneumatic members cooperating with a chute within a closed system to randomly orient a series of spherical members therewithin.

2. Description of the Prior Art

The use of random number selection apparatus is well known in the prior art. Historically, the devices have been of various mechanical and dynamic constructions to select numbers randomly in a typical game of chance, such as a lottery. For example, U.S. Pat. No. 1,602,358 to Getsky sets forth a dispensing container wherein a series of balls with a numerical impression thereon are released one at a time from a hopper through a chute-like orientation. The Getsky patent sets forth a mere ball dispensing apparatus, but is of interest relative to the use of an elongate chute in the dispensing of balls therein.

U.S. Pat. No. 2,203,886 to Zamora sets forth a ball delivery machine wherein rotation of a cage enables delivery of balls in an orderly manner through an elongate chute wherein the chute projects interiorly of the cage at one end and exteriorly and axially of the cage at an other end to enable dispensing of balls one at a time to the chute.

U.S. Pat. No. 3,140,875 to Abbott sets forth a random ball selection apparatus wherein rotation of a cage axially thereof delivers balls into an overlying chute wherein the chute includes a pneumatically pressurizable conduit separate from the cage to enable pressurization of the conduit for dispensing of balls therethrough.

U.S. Pat. No. 3,468,452 to Ernest sets forth a rotating drum mixing apparatus wherein a plurality of marked balls may be inserted axially through a hollow cage and the rotation of the drum in one direction enables intermixing of the balls and when rotation in the other direction is effected, the balls are dispensed through the other axle of the cage organization.

U.S. Pat. No. 3,679,208 to Carrano sets forth a game apparatus in which spherical counter-pieces are positioned in a bottom portion of a spherical enclosure wherein a catching device within the enclosure may be manipulated to catch one or more of the pieces when the individual spherical pieces are projected upwardly by means of an underlying mechanical "kicker" device.

As such, it may be appreciated that there is a continuing need for a new and improved random number selection apparatus which addresses both the problems of effectivenesss and ease of use and in this respect the present invention substantially fulfills this need.

SUMMARY OF THE INVENTION

In view of the foregoing disadvantages inherent in the known types of random number selection apparatus now present in the prior art, the present invention provides a random number selection apparatus wherein the same provides for a true random selection of spherical balls projected through the air by means of an underlying blower motor and are oriented to position each of a first series of balls in a predetermined orientation utilizing magnetic force for random number selection. As such, the general purpose of the present invention, which will be described subsequently in greater detail, is to proivde a new and improved random number selection apparatus which has all the advantages of the prior art random number selection apparatus and none of the disadvantages.

To attain this, the present invention comprises a sealed enclosure containing a plurality of hollow spheres wherein the floor of the enclosure is of curvilinear configuration formed with a lowermost point proximate an outlet of a blower motor to project the various spheres in an airborne manner and wherein a diagonally oriented chute relative to the enclosure includes an enlarged ellipsoidal medially positioned elongate trough portion somewhat medially of the chute to accept the airborne spheres and deliver the spheres through an aligned chute to position these spheres utilizing magnetic fields to proivde for random number selection. The chute portion includes the air intake conduit for the lower motor to provide a closed system within the enclosure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is in intended to be limiting as to the scope of the invention in any way.

It is therefore an object of the present invention to provide a new and improved random number selection apparatus which has all the advantages of the prior art random number selection apparatus and none of the disadvantages.

It is another object of the present invention to provide a new and improved random number selection apparatus which may be easily and efficiently manufactured and marketed.

It is a further object of the present invention to provide a new and improved random number selection apparatus which is of a durable and reliable construction.

An even further object of the present invention is to provide a new and improved random number selection apparatus which is susceptible of a low cost of manufacture with regard to both materials and labor, and which accordingly is then susceptible of low prices of sale of the consuming public, thereby making such random number selection apparatus economically available to the buying public.

Still yet another object of the present invention is to provide a new and improved random number selection apparatus which provides in the apparatuses and methods of the prior art some of the advantages thereof, while simultaneously overcoming some of th disadvantages normally associated therewith.

Still another object of the present invention is to provide a new and improved random number selection apparatus wherein the same includes a plurality of spheres that are airborne by means of a blower motor positioned underlying an enclosure for effecting random securement of a series of spheres wherein the spheres contain a series of numbers thereon for random number selection.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front orthographic view taken in elevation of the instant invention.

FIGS. 2, 3, 4, and 5 are orthographic illustrations of various spheres utilized by the instant invention.

FIG. 6 is a side orthographic view of the instant invention.

FIG. 11 is a top orthographic view of the instant invention.

FIG. 12 is an isometric illustration of the removable top lid of the horizontal chute of the instant invention.

DESCRIPTION OF THE PREFERRED EMBODIMENT

Figure 7:
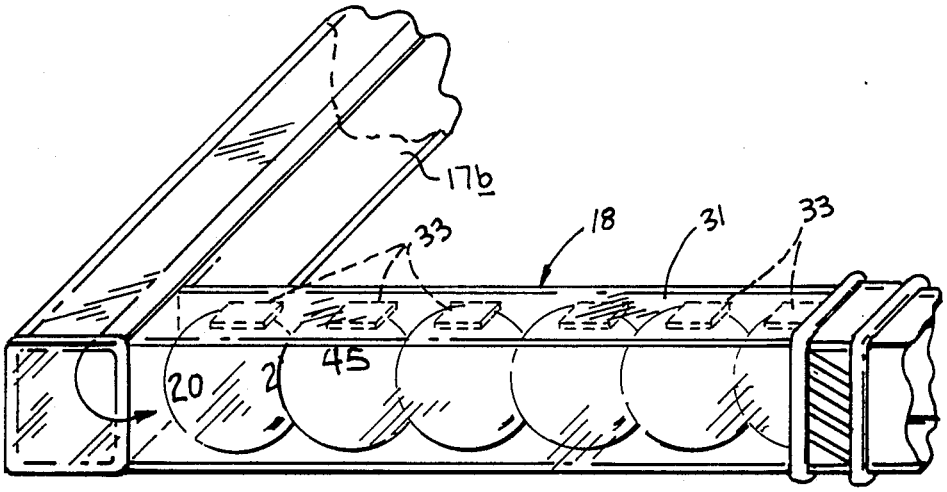
FIG. 7 is an isometric illustration of a lowermost portion of the chute of the instant invention.

With reference now to the drawings, and in particular to FIGS. 1 to 12 thereof, a new and improved random number selection apparatus embodying the principles and concepts of the present invention and generally designated by the reference numeral 10 will be described.

More specifically, the random number selection apparatus of the instant invention comprises a transparent enclosure formed by a perimeter skeleton framework 11*a* of metallic or polymeric construction. Transparent end panels 12 with transparent top panels 13 and a hingedly mounted transparent top panel 14 enable visual observation of the interior of the enclosure 11.

The top panel 14 is sealingly secured to the top of the enclosure 11 utilizing conventional sealing members, such as foam of the like. An elongate hinge 15 is coextensively formed to a side and top portion of the enclosure to enable pivotment of the top panel 14.

An enlarged base portion 16 provides stability and confinement of various elements, such as the blower motor, return duct work, etc., to be discussed in more detail below.

A diagonal chute portion 17 is formed with an upper chute portion 17*a* and a lower portion 17*b* with an ellipsoidal trough positioned somewhat medially thereof. The ellipsoidal trough is formed with an enlarged support surface of approximately three to seven times the support surface or floor of an associated diagonal chute portion. The diagonal chute portion is angulated from an uppermost portion of a rear end panel 12 proximate an intersection with a side panel and angulates downwardly towards an opposed intersection of an opposed side panel and end panel 13 and 12 respectively, as may be seen in FIG. 11 for example. The diagonal chute 17 angularly directed downwardly is directed into and intersects a horizontal chute 18 which is positioned exteriorly and forwardly of a forward end panel 12, as illustrated in FIGS. 6 and 11 for example.

The enclosure 11 is formed with an arcuate floor within the enclsoure that tapers downwardly and rearwadly towards a fan outlet 20 of an associated blower fan, as illustrated in FIG. 11 in phantom. The floor 19 formed within the base 16 and defining a floor of the enclosure 11 is formed as an arcuate floor with a lowermost depression adjacent to direct the spheres within the enclosure towards the fan outlet 20 to enhance projection of the spheres within the confines of the enclosure 11.

A number of balls 22, as illustrated in FIGS. 2 through 5 for example, are formed with six equally spaced magnetic numbers of a first polarity. The balls 22 are projected upwardly by means of force from the fan outlet 20 and collect within the ellipsoidal trough 21 and directed downwardly towards the horizontal chute 18. The horizontal chute 18 is formed with a series of overlying magnets of a second polarity that is reversed to that of the magnets formed on the balls 22 to attract one of the six numbers formed on the respective balls 22.

Figure 8:
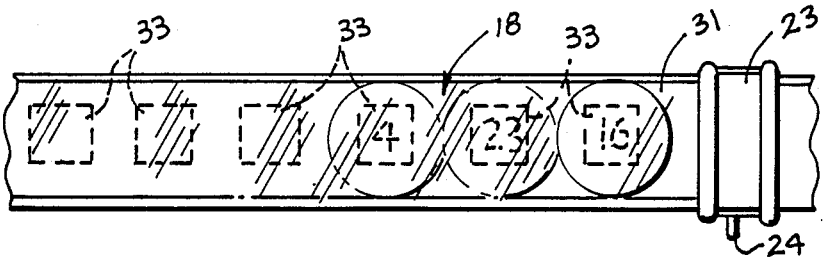
FIG. 8 is a top orthographic view of the lowermost chute of the instant invention.
Figure 9:
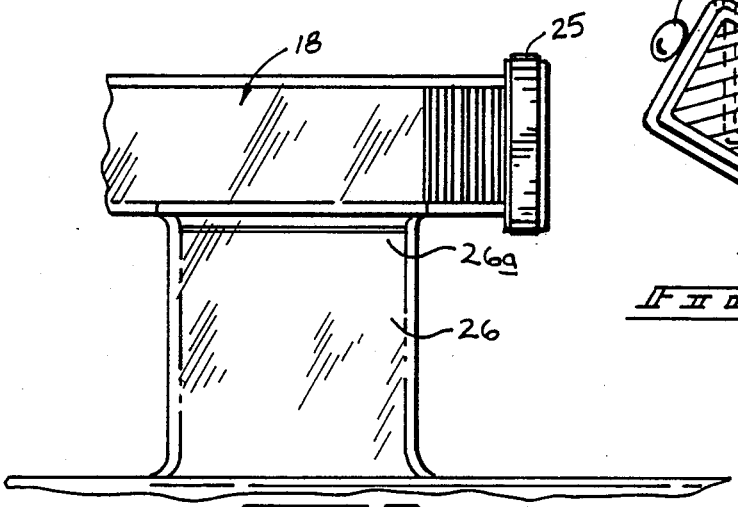
FIG. 9 is an orthographic frontal view, somewhat enlarged, of the evacuating chamber of the chute of the instant invention.
Figure 10:
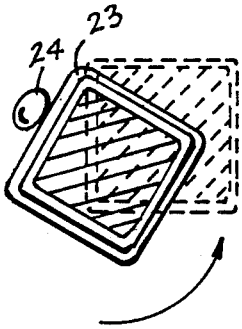
FIG. 10 is an end orthographic view of FIG. 9 illustrating the pivotal latch relative to the chute.

A pivotally mounted screen door 23 forms an abutment to prevent the balls 22 from passing and maintains the balls in alignment underlying the magnets 33, as illustrated in FIGS. 7 and 8 for example. A handle 24 formed to the door 23 enables manual securement and pivotal displacement of the respective door 23 to enable the balls to proceed and be removed outwardly by means of an end plug 25 formed on a terminal end of the horizontal conduit 18 for removal of the balls and enable replacement thereof of balls of various numeral or alphabetic combinations for use with the instant invention.

A return duct 26 is directed orthogonally downwardly relative to the horizontal chute 18 and is formed with a screen 26*a* to prevent debris from being withdrawn downwardly into the return duct 26 with a horizontal return duct 27 formed within the base 16 to provide a supply of air to the blower motor and the associated cage blower 30 to effect a closed system within the enclosure 11. A plurality of batteries 28 are also positionable within the base 16 to provide a portable apparatus that may be positioned as desired.

A top lid 31 is removably secured to the horizontal chute 18 by peripheral hook and loop fasteners 32 cooperating with hook and loop fasteners on upper edges of the chute 18, as illustrated in FIG. 12, to enable removal of the particular balls 22 that are positioned and secured to the magnets 33. It is to be understood that the motor 29 is deactivated prior to such removal.

Accordingly, the manner of usage and operation of the instant invention should be understood from the above disclosure whereupon the cage blower 30 effecting a pressure within the enclosure 11 effects projection of the spheres 22 about the interior of the enclosure 11 whereupon a random number of such spheres will be caught and pulled through the conduit 17 after being caught on the ellipsoidal trough 21. The balls are thereby downwardly directed into the horizontal chute 18 whereupon a deactivation of the motor 29 enables ready removal of the top lid 31 to provide for a random number selection of one of the six numbers positioned on each of the balls 22.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A random ball selector apparatus for random selection of a pre-selected number of digits from a plurality of spheres, said apparatus comprising, a stationary transparent enclosure formed with an opaque base portion, spaced transparent side panels, and spaced transparent end panels;

a plurality of spheres;

a pressurizing means formed in said base to project and direct airborne a plurality of spheres within said enclosure wherein each sphere includes at least one numerical digital display thereon, and a first chute diagonally oriented from an upper level of said enclosure to a lower level of said enclosure, and a catch means positioned within said first chute for catching the airborne spheres within said enclosure and directing said spheres downwardly within said first chute, and a second chute angularly disposed and and associated with said first chute to accept spheres within said second chute and to randomly secure a preselected number of said spheres within said second chute for random selection of digits imprinted on said spheres, and wherein each of said spheres has formed thereon a plurality of numerical digits equally spaced about a surface of each sphere, and wherein each of said digits is of a first magnetic polarity and wherein a pre-selected number of magnetic members of a reverse second magnetic polarity is formed in a top surface of said second chute for alignment of selective ones of said digits within said chute.

2. A random ball selector apparatus as set forth in claim 1 wherein said top surface of said chute is removably secured to said chute by hook and loop fasteners formed and associating said lid with said second chute.

3. A random ball selector apparatus as set forth in claim 2 wherein said second chute has associated therewith a return duct with a horizontal duct associating said return duct to said pressurizing means and wherein said pressurizing means comprises a fan.

4. A random ball selector apparatus as set forth in claim 3 wherein a floor portion formed in said base is arcuately formed to direct spheres within said enclosure towards said pressurizing means.

5. A random ball selector apparatus as set forth in claim 4 wherein said catch means comprises an ellipsoidal trough formed with an enlarged support surface relative to said first chute to accept spheres thereon to direct the spheres into the first chute wherein the ellipsoidal trough is aligned with said first chute.

6. A random ball selector apparatus as set forth in claim 5 wherein said ellipsoidal trough is formed with a support surface of three to seven times the surface area of the first chute.

7. A random ball selector apparatus as set forth in claim 6 wherein said second chute is formed with a removable end plug at a terminal end thereof and a pivotal door positioned adjacent said removal lid for enabling selective removal of spheres for replacement thereof.

8. A random ball selector apparatus as set forth in claim 7 wherein said pivotal door is formed with air passing means to enable flow of air through said second chute and through said return duct wherein said return duct is formed with an overlying screen to prevent unwanted debris from entering said return duct.

* * * * *